US007455557B2

(12) United States Patent
Mizutani

(10) Patent No.: US 7,455,557 B2
(45) Date of Patent: Nov. 25, 2008

(54) CONTROL UNIT FOR MULTIPLE INSTALLATION OF PROPULSION UNITS

(75) Inventor: Makoto Mizutani, Shizuoka-ken (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 17 days.

(21) Appl. No.: 11/588,060

(22) Filed: Oct. 25, 2006

(65) Prior Publication Data

US 2007/0093147 A1 Apr. 26, 2007

(30) Foreign Application Priority Data

Oct. 25, 2005 (JP) ..... 2005-310188

(51) Int. Cl.
*B63H 21/22* (2006.01)

(52) U.S. Cl. ..... 440/1

(58) Field of Classification Search ..... 440/1
See application file for complete search history.

(56) References Cited

U.S. PATENT DOCUMENTS

| | | | | |
|---|---|---|---|---|
| 2,215,003 | A | 9/1940 | Johnson | |
| 2,224,357 | A | 12/1940 | Pecker | |
| 3,084,657 | A | 4/1963 | Kiekhaefer | |
| 3,176,645 | A * | 4/1965 | Shatto, Jr. | 114/144 B |
| 3,233,691 | A | 2/1966 | De Biasi | |
| 3,310,021 | A | 3/1967 | Shimanckas | |
| 3,349,744 | A | 10/1967 | Mercier et al. | |
| 4,120,258 | A | 10/1978 | Spurgin | |
| 4,220,111 | A | 9/1980 | Krautkremer et al. | |
| 4,373,920 | A | 2/1983 | Hall et al. | |
| 4,500,298 | A | 2/1985 | Hall et al. | |
| 4,519,335 | A | 5/1985 | Krautkremer et al. | |
| 4,637,802 | A | 1/1987 | Taguchi et al. | |
| 4,787,867 | A | 11/1988 | Takeuchi et al. | |
| 4,872,857 | A | 10/1989 | Newman et al. | |
| 4,908,766 | A | 3/1990 | Takeuchi | |
| 4,909,765 | A | 3/1990 | Riske et al. | |
| 5,029,547 | A | 7/1991 | Novey | |
| 5,031,562 | A | 7/1991 | Nakase et al. | |
| 5,231,888 | A | 8/1993 | Katahira | |

(Continued)

FOREIGN PATENT DOCUMENTS

| | | |
|---|---|---|
| JP | 62-166193 | 7/1987 |

(Continued)

OTHER PUBLICATIONS

Co-Pending U.S. Appl. No. 11/515,600, filed Sep. 5, 2006. Inventor: Mizutani. (submitted herewith) Title: Steering System for a Small Boat.

(Continued)

*Primary Examiner*—Stephen Avila
(74) *Attorney, Agent, or Firm*—Knobbe, Martens, Olson & Bear, LLP

(57) ABSTRACT

A control unit for controlling multiple propulsion units can include plural propulsion units mounted at the stern of the boat to generate thrust. A control unit can be used to control the driving of each propulsion unit, and a target speed setting device can be used to establish a target speed of the boat, in which the control unit controls the driving of each propulsion unit according to the preset driving pattern to attain the target speed.

14 Claims, 9 Drawing Sheets

U.S. PATENT DOCUMENTS

| | | | | |
|---|---|---|---|---|
| 5,235,927 | A | 8/1993 | Singh et al. | |
| 5,244,426 | A | 9/1993 | Miyashita et al. | |
| 5,253,604 | A | 10/1993 | Bohlin | |
| 5,361,024 | A | 11/1994 | Wisner et al. | |
| 5,370,564 | A | 12/1994 | Fujimoto et al. | |
| 5,533,935 | A | 7/1996 | Kast | |
| 5,800,223 | A | 9/1998 | Iriono et al. | |
| 5,997,370 | A | 12/1999 | Fetchko et al. | |
| 6,079,513 | A | 6/2000 | Nishizaki et al. | |
| 6,230,642 | B1 | 5/2001 | McKenney et al. | |
| 6,234,853 | B1 * | 5/2001 | Lanyi et al. | 440/53 |
| 6,273,771 | B1 | 8/2001 | Buckley et al. | |
| 6,357,375 | B1 * | 3/2002 | Ellis | 114/144 R |
| 6,402,577 | B1 | 6/2002 | Treinen et al. | |
| 6,405,669 | B2 | 6/2002 | Rheault et al. | |
| 6,471,556 | B1 | 10/2002 | Yamashita et al. | |
| 6,511,354 | B1 | 1/2003 | Gonring et al. | |
| 6,535,806 | B2 | 3/2003 | Millsap et al. | |
| 6,561,860 | B2 | 5/2003 | Colyvas | |
| 6,655,490 | B2 | 12/2003 | Andonian et al. | |
| 6,671,588 | B2 | 12/2003 | Otake et al. | |
| 6,678,596 | B2 | 1/2004 | Husain et al. | |
| 6,843,195 | B2 | 1/2005 | Watabe et al. | |
| 6,855,014 | B2 | 2/2005 | Kinoshita et al. | |
| 6,892,661 | B2 | 5/2005 | Kishi et al. | |
| 6,892,662 | B2 | 5/2005 | Watanabe et al. | |
| 6,994,046 | B2 * | 2/2006 | Kaji et al. | 114/144 R |
| 6,997,763 | B2 | 2/2006 | Kaji | |
| 7,004,278 | B2 | 2/2006 | Sugitani et al. | |
| 2003/0077953 | A1 | 4/2003 | Kaji | |
| 2003/0150366 | A1 | 8/2003 | Kaufmann et al. | |
| 2003/0224670 | A1 | 12/2003 | Takada et al. | |
| 2003/0224672 | A1 | 12/2003 | Takada et al. | |
| 2004/0007644 | A1 | 1/2004 | Phelps et al. | |
| 2004/0031429 | A1 | 2/2004 | Kaufmann et al. | |
| 2004/0121665 | A1 | 6/2004 | Mizuguchi et al. | |
| 2004/0139902 | A1 | 7/2004 | Takada et al. | |
| 2004/0139903 | A1 | 7/2004 | Watabe et al. | |
| 2005/0118894 | A1 | 6/2005 | Kawanishi | |
| 2005/0121975 | A1 | 6/2005 | Gronau et al. | |
| 2005/0170712 | A1 | 8/2005 | Okuyama | |
| 2005/0170713 | A1 | 8/2005 | Okuyama | |
| 2005/0199167 | A1 | 9/2005 | Mizutani | |
| 2005/0199168 | A1 | 9/2005 | Mizutani | |
| 2005/0199169 | A1 | 9/2005 | Mizutani | |
| 2005/0215131 | A1 | 9/2005 | Tokunaga | |
| 2005/0282447 | A1 | 12/2005 | Okuyama | |
| 2006/0019558 | A1 | 1/2006 | Mizutani et al. | |
| 2006/0037522 | A1 | 2/2006 | Kaneko et al. | |
| 2006/0180070 | A1 | 8/2006 | Mizutani | |
| 2006/0217012 | A1 | 9/2006 | Mizutani | |
| 2007/0049139 | A1 | 3/2007 | Mizutani | |
| 2007/0066157 | A1 | 3/2007 | Yamashita et al. | |

FOREIGN PATENT DOCUMENTS

| | | | |
|---|---|---|---|
| JP | 01-314695 | | 12/1989 |
| JP | 02-179597 | | 7/1990 |
| JP | 02-227395 | | 9/1990 |
| JP | 03-148395 | | 6/1991 |
| JP | 04-038297 | | 2/1992 |
| JP | B-HEI 6-33077 | | 5/1994 |
| JP | 2739208 | B2 | 1/1998 |
| JP | 10-226346 | | 8/1998 |
| JP | A-HEI 10-310074 | | 11/1998 |
| JP | 2959044 | B2 | 7/1999 |
| JP | 2000-318691 | | 11/2000 |
| JP | 2003-313398 | | 11/2000 |
| JP | 3232032 | | 9/2001 |
| JP | A-2002-331948 | | 11/2002 |
| JP | A-2004-155282 | | 6/2004 |
| JP | 2005-254848 | | 9/2005 |

OTHER PUBLICATIONS

Co-Pending U.S. Appl. No. 11/516,151, filed Sep. 5, 2006. Inventor: Mizutani. (submitted herewith) Title: Steering Method and Steering System for Boat.

Co-Pending U.S. Appl. No. 11/593,393, filed Nov. 6, 2006. Inventor: Mizutani. (submitted herewith) Title: Electric Type Steering Device for Outboard Motors.

Co-pending U.S. Appl. No. 11/942,179, filed Nov. 19, 2007. Title: Watercraft Steering System, and Watercraft.

Co-pending U.S. Appl. No. 11/942,187, filed Nov. 19, 2007. Title: Watercraft Steering System, and Watercraft.

Co-pending U.S. Appl. No. 11/942,159, filed Nov. 19, 2007. Title: Watercraft Steering Device and Watercraft.

Co-Pending U.S. Appl. No. 11/075,131, filed Mar. 8, 2005. Now issued as US 7063030 (submitted herewith). Title: Electric Steering Apparatus for Watercraft.

* cited by examiner

CONTROL UNIT FOR MULTIPLE INSTALLATION OF PROPULSION UNITS

PRIORITY INFORMATION

This application is based on and claims priority under 35 U.S.C. §119 to Japanese Patent Application No. 2005-310188, filed on Oct. 25, 2005, the entire contents of which is hereby expressly incorporated by reference herein.

BACKGROUND OF THE INVENTIONS

1. Field of the Inventions

The present inventions relate to a control unit for boats with multiple propulsion units, such as outboard motors or sterndrives (hereinafter inclusively referred to as "outboard motors").

2. Description of the Related Art

An electric steering device for a small boat is disclosed in Japanese Patent Document JP-B-2959044. This electric steering device is designed to implement the steering action by and electric motor instead of the more traditional hydraulic mechanism. Smooth operation and accurate controllability can be obtained by such electric steering devices. This electric steering device is coupled to an outboard motor. A turning angle corresponding to the steering angle of the steering wheel is calculated by a control unit 12. Then, the electric steering device is driven according to the calculated turning angle to implement the steering action of the outboard motor.

The outboard motor in Japanese Patent Document JP-B-2959044 is connected to the steering wheel via the electric steering device, and is also connected to a remote control unit which has plural throttle levers. The remote control unit is disposed in the vicinity of the steering wheel at the operator's seat. The transmission is shifted into forward, reverse, or neutral by the operation of the throttle levers. The thrust is also controlled by tilting the throttle levers forwardly and rearward.

Generally, outboard motors provide thrust by transmitting the rotational power from the engine to a propeller via the transmission. Therefore, the minimum outboard motor thrust is generated the lowest sustainable engine speed; a speed at which the engine can run continuously without stalling.

For the trolling, for example during fishing, it is desirable to use a boat speed that is as low as possible, particularly where the operator is using the same outboard motor for both trolling and propulsion at normal cruising speed for the associated boat. However, outboard motors designed to provide achieve cruising speed operation, which can include planning speeds for smaller boats, cannot operate at a speed low enough to achieve appropriate trolling speeds. As such, operators often use separate smaller motors for trolling at appropriate trolling speeds.

FIG. 9 shows the speed relative to the throttle lever angle of the outboard motor of Japanese Patent Document JP-B-2959044.

The transmission gear is shifted into F (forward) when the throttle lever is tilted forward by the predetermined angle from the N (neutral) position. Tilting the throttle lever further forward will open the throttle gradually until it reaches the wide open throttle position. In this case, the speed v1 corresponds to the lower limit of outboard motor engine speed is attained when the transmission gear is shifted into F. In other words, the outboard motor engine cannot run at a speed below v1 without stalling. As the associated throttle lever is moved further, the speed increases up to WOT (wide open throttle) so far as the load remains constant. Thus, the lowest speed is the speed v1 corresponding to shift position F. No speed adjustment can be made in the extremely low speed range from 0 to v1 by the single outboard motor.

FIGS. 10A and 10B show a low speed control method for a boat having three outboard motors. FIG. 11 illustrates a remote control unit for controlling the three outboard motors of FIGS. 10A and 10B.

With reference to FIGS. 10A and 10B, the three outboard motors 3*a*, 3*b*, 3*c* are installed at the stern of a hull 1 of a small boat. A remote control unit 30 is provided in the vicinity of operator's seat (not sown) for controlling the driving of the three outboard motors 3*a*, 3*b*, 3*c*. The remote control unit 30 has throttle levers 31*a*, 31*b*, 31*c* connected to the outboard motors 3*a*, 3*b*, 3*c* respectively.

As shown in FIG. 11, the three throttle levers 31*a*, 31*b*, 31*c* can be operated independently, and are moveable from the neutral position (N) that is the vertical position at the center, to the forward shift position (F) where the throttle lever is tilted forward by the predetermined angle from the N position, and further to the wide open throttle (WOT) position where the throttle lever is tilted further forward. Also, in the reverse direction, the three throttle levers 31*a*, 31*b*, 31*c* are moveable from the N position to the reverse shift position (R) where the throttle lever is tilted rearward by the predetermined angle from the N position, and further to the wide open throttle (WOT) position where the throttle lever is tilted further rearward. The transmission gear shifts into forward and reverse at F position and R position, respectively. The throttle is fully closed (the lowest speed that would not cause engine stall) at each of those positions F, R. This means that the neutral position covers the range from F position to R position where the transmission gear is not engaged. Forward gear position lies in the area forward of F position, while reverse gear position lies in the area rearward of R position.

In FIG. 10(A), only the central outboard motor 3*b* is shifted into F (forward), while the left and right outboard motors 3*a*, 3*c* are in N (neutral) position.

In FIG. 10(B), the central outboard motor 3*b* is in N position, while the left and right outboard motors 3*a*, 3*c* are shifted into F.

As described above, when only part of the plural outboard motors are shifted into F with the rest of the outboard motors are kept in N, the boat speed can be reduced further from the speed at which all three outboard motors are shifted into F at the lowest speed. Also, additional speed reduction is practicable when part of the plural outboard motors are shifted into F with the rest of the outboard motors being shifted into R, and the forward thrust and the rearward thrust are adjusted by the throttle lever operation.

However, operating the three throttle levers 31*a*, 31*b*, 31*c* corresponding to the three outboard motors 3*a*, 3*b*, 3*c* is difficult in terms of correct throttle lever selection and adjustment of the tilting angle of each throttle lever. Such difficult operation makes it difficult operator to achieve smooth and comfortable operation.

SUMMARY OF THE INVENTIONS

An aspect of at least one of the embodiments disclosed herein includes the realization that by independently controlling multiple propulsion units, certain additional modes of low speed operation can be achieved. For example, by independently controlling the thrust amount and/or thrust direction of a plurality of propulsion units, the speed of the associated craft can be maintained at a speed that is lower than that corresponding to using a single propulsion unit producing thrust at its lowest possible engine speed.

Thus, in accordance with an embodiment, a propulsion system can comprise a plurality of propulsion units mounted at the stern of the boat, each of the propulsion units configured to generate thrust for propelling the boat. A control unit can be configured to control the operation of each propulsion unit. A target speed setting device can be configured to establish a target speed of the boat, wherein the control unit is further configured to control the driving of each propulsion unit according to the preset driving pattern to attain the target speed.

In accordance with another embodiment, a propulsion system can comprise a plurality of propulsion units mounted at the stern of the boat, each of the propulsion units configured to generate thrust for propelling the boat a control unit configured to control the operation of each propulsion unit and a target speed setting device configured to establish a target speed of the boat, wherein the control unit includes means for independently changing a thrust amount and thrust direction of each of the propulsion units to provide a plurality of different low speed forward propulsion modes each of which provide a forward boat speed that is lower than a speed resulting from only one of the propulsion units being operated in a forward mode of operation at its lowest engine speed.

BRIEF DESCRIPTION OF THE DRAWINGS

The abovementioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION OF THE PREFERRED EMBODIMENT

Figure 1:
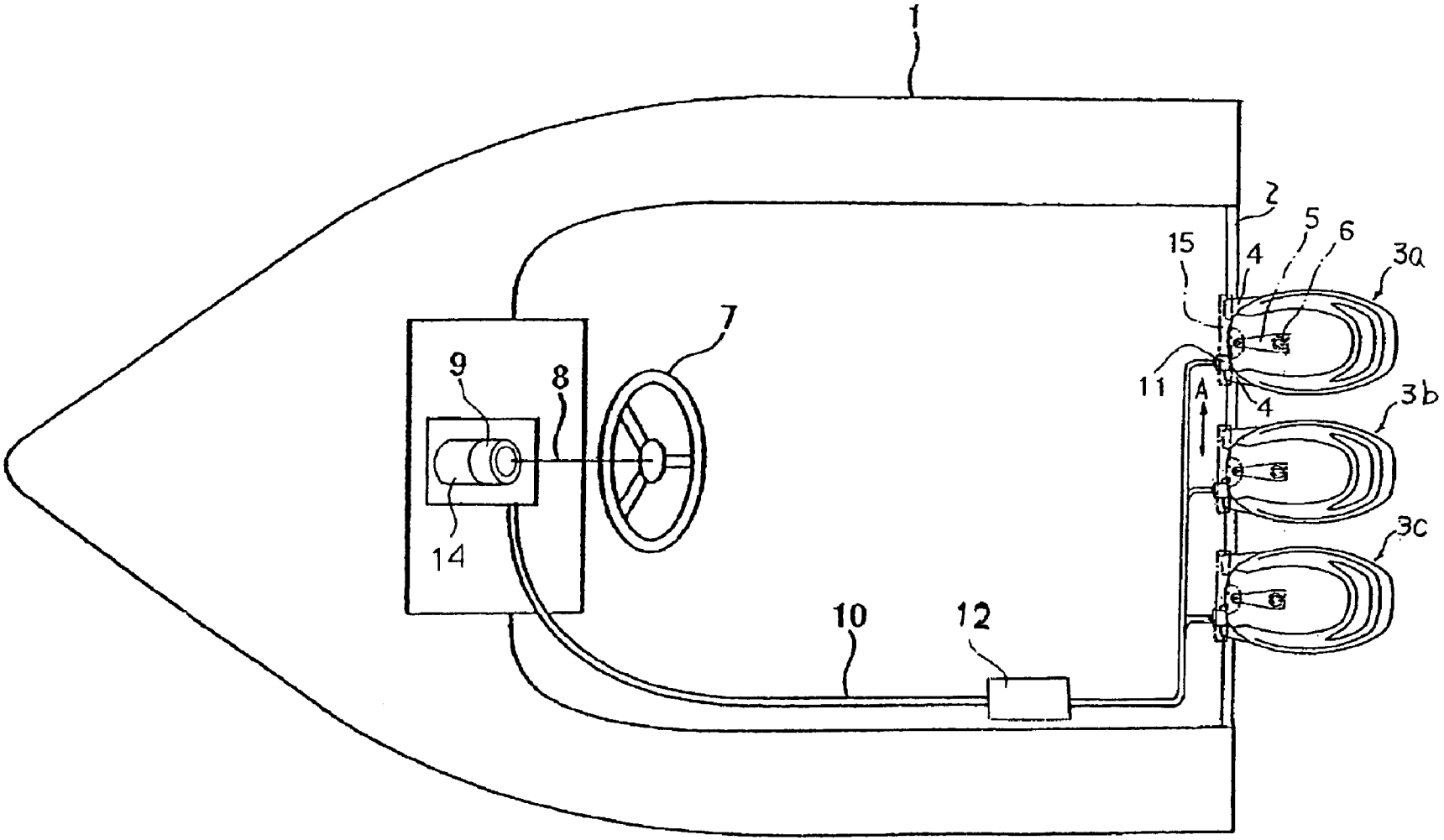
FIG. 1 is an overall top plan view of a small boat in accordance with an embodiment.

FIG. 1 is a schematic top plan view of a boat 1 including multiple outboard motors and a low speed control system. The embodiments disclosed herein are described in the context of a marine propulsion system of a small boat having multiple outboard motors, and more particularly, three outboard motors, because these embodiments have particular utility in this context. However, the embodiments and inventions herein can also be applied to other marine vessels, such as personal watercraft and small jet boats, as well as other land and marine vehicles. It is to be understood that the embodiments disclosed herein are exemplary but non-limiting embodiments, and thus, the inventions disclosed herein are not limited to the disclosed exemplary embodiments.

With reference to FIG. 1, three outboard motors 3*a*, 3*b*, 3*c* can be installed on the transom plate 2 of the hull 1 via a clamp bracket 4. The outboard motors 3*a*, 3*b*, 3*c* can rotate around a swivel shaft 6, which can be generally vertical. A steering bracket 5 can be fixed to the upper end of the swivel shaft 6.

A steering device 15, which can be operated by an electric motor 20 (FIG. 3), can be coupled to the front end portion of the steering bracket 5. When the electric motor 20 of the steering device 15 slides in the direction of arrow A, the outboard motors 3*a*, 3*b*, 3*c* turns around the swivel shaft 6 via the steering bracket 5 in accordance with the turning angle. Each of the outboard motors 3*a*, 3*b*, 3*c* and the steering device 15 can be connected to a control unit (ECU) 12 via controllers 11 (11*a* and 11*b* in FIG. 2) so that the control unit 12 can take control of the outboard motor engine output and the turning angle of the steering device 15.

With continued reference to FIG. 1, a steering wheel 7 can be provided at the operator's seat (not shown). The steering angle resulting from rotation of the steering wheel 7 can be detected by a steering angle sensor 9 which can be configured to detect rotation of the steering wheel shaft 8.

The detected steering angle information can be transmitted to the control unit 12 by way of a cable 10. The steering wheel shaft 8 can also be coupled to a reaction force motor 14. Reaction torque can be calculated by the control unit 12 in accordance with the steering angle and an external force being exerted on the respective outboard motor 3*a*, 3*b*, 3*c*. The reaction torque obtained by the calculation can be imposed on the steering wheel 7 by the reaction force motor 14. In this way, the reaction force can be imposed in response to the steering wheel operation that depends on the running state of the boat. Thus, the boat operator can experience the operating feeling such as heavy-load feeling or light-load feeling through the steering wheel.

Figure 2:
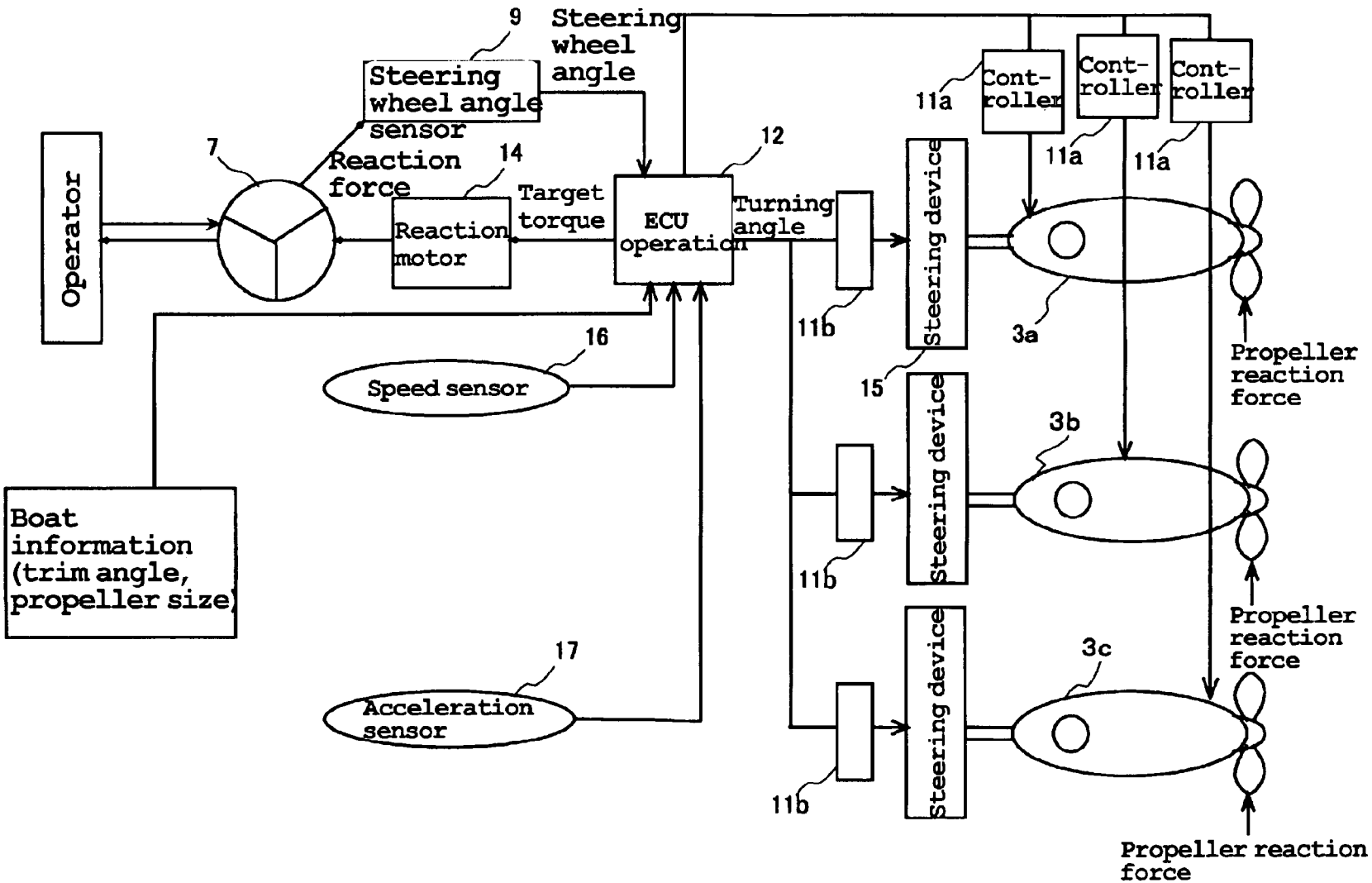
FIG. 2 is a block diagram of a steering control system that can be used in the small boat of FIG. 1.

With reference to FIG. 2, the control unit 12 can be connected to a speed sensor 16 and an acceleration sensor 17. The rotational operation angle of the steering wheel 7 can be detected by a steering angle sensor 9, and the steering angle data are input to the control unit 12. Various other kinds of detected running state data including engine conditions and boat attitude, as well as the speed data provided by the speed sensor 16 can be input to the control unit 12. Further, the throttle opening data provided by the acceleration sensor 17 can be input to the control unit 12.

The control unit 12 can be connected to each of the outboard motors 3*a*, 3*b*, 3*c* via the controllers 11*a* so that the control unit 12 can take control of the respective outboard motor engine output by adjusting the ignition timing and the fuel injection for each engine and/or other operational parameters. Further, the control unit 12 can be connected to the steering device 15 for each of the outboard motors 3*a*, 3*b*, 3*c* via the controllers 11*b* for controlling the turning angle.

The controllers 11*a*, 11*b* for each of the outboard motors may be formed into one component. Alternatively, they may be incorporated into the control unit 12.

The speed sensor 16 can be configured to detect speed by directly detecting the speed through the water with an impeller provided at the bottom of the hull, or by calculating the speed over the ground based on the positional data obtained by the GPS. Alternatively, the speed can be estimated based on the engine speed and the throttle opening. The acceleration sensor 17 can include a position sensor or an angular sensor mounted on a throttle lever, and a turning angle sensor mounted on a rotating shaft, for example. However, other configurations can also be used.

The control unit 12 can be configured to calculate the target torque for the reaction force to be imposed on the steering wheel based on the steering angle data, the boat information, the running state data, and/or other data. Then, the reaction force can be exerted on the steering wheel 7 by driving the reaction force motor 14. Further, the boat information including trim angle and propeller size can be input to the control device 12.

As illustrated in FIG. 1, three outboard motors 3*a*, 3*b*, 3*c* can be installed on the transom plate 2 of the hull of the boat 1. The steering device 15 on each of the outboard motors 3*a*, 3*b*, 3*c* can be connected to the control unit 12.

On receipt of the turning angle command value from the control unit 12, the steering device 15 can drive the electric motor (not shown) to cause the steering motion. The control unit 12 can also be connected to the engine (not shown) within each of the outboard motors 3*a*, 3*b*, 3*c* for adjusting the engine throttle opening, the fuel injection, the igniting timing, and/or other operational parameters to control the output from each outboard motor.

The propeller reacting force (F) can be exerted on each of the outboard motors 3*a*, 3*b*, 3*c*. The propeller reaction force can be exerted on an outboard motor due to the rotation of the propeller. A biasing force called the "paddle-rudder effect" or "gyroscopic effect" can be generated by the propeller reaction force, which can change the orientation of the outboard motor to make the boat heading change.

Figure 3:
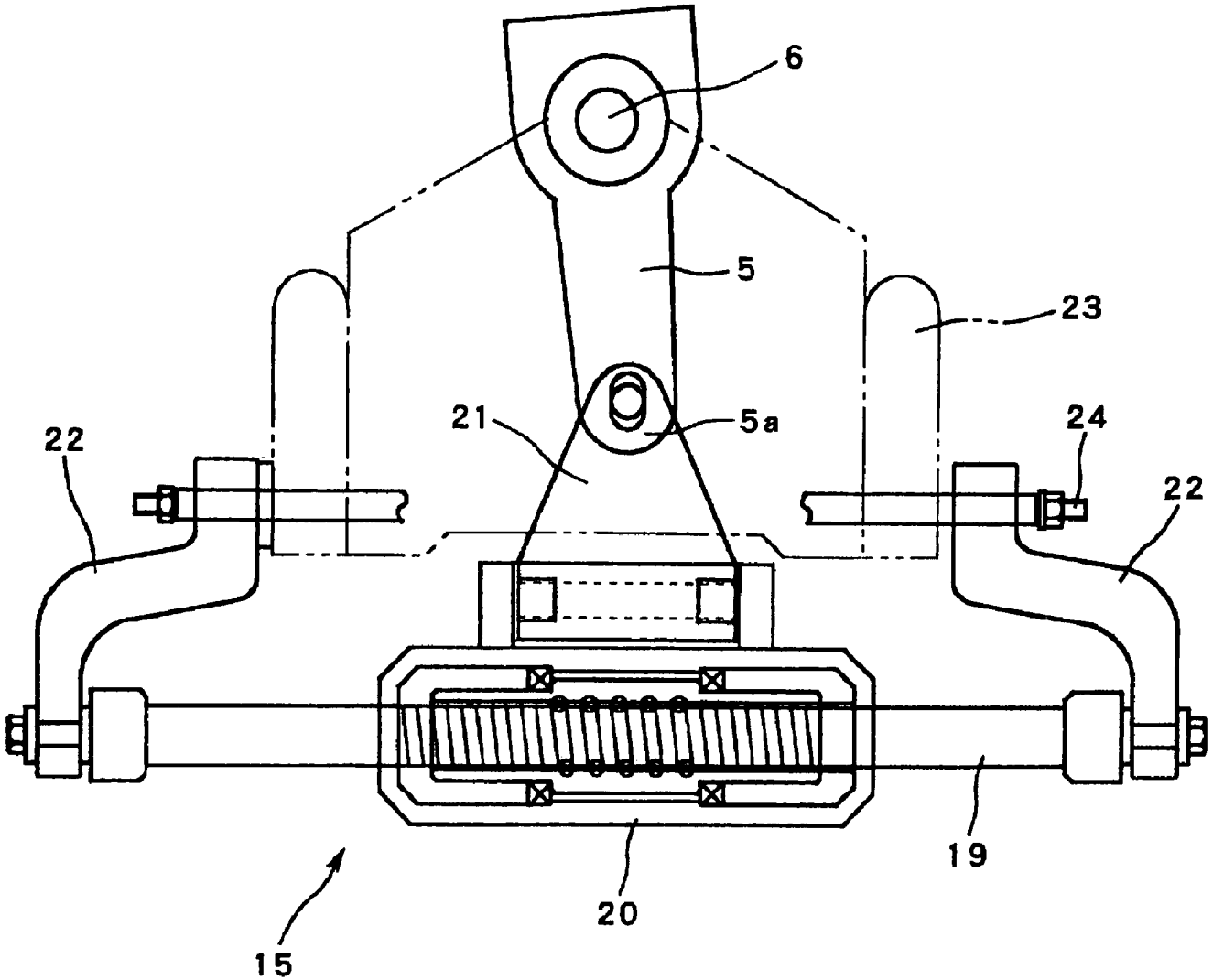
FIG. 3 is an enlarged schematic top plan view of a steering device that can be used in the small boat of FIG. 1 and/or the steering system of FIG. 2.

With reference to FIG. 3, an electric motor 20 can form part of the steering device 15. The electric motor 20 can be a DD (Direct Drive) type motor mounted to a screw rod 19 for sliding along the screw rod 19. The both ends of the screw rod 19 can be fixed to the transom plate (not shown) with a supporting member 22. The reference numeral 23 denotes a clamping portion of the clamp bracket. The reference numeral 24 denotes a tilting shaft. The steering bracket 5 can be fixed to the swivel shaft 6 on each of the outboard motors 3*a*, 3*b*, 3*c* (FIG. 1), with the electric motor 20 being coupled to the front end portion 5*a* of the steering bracket 5 via a coupling bracket 21. However, other configurations can also be used.

In such configurations, sliding motion of the electric motor 20 along the screw rod 19 in accordance with the amount of steering wheel displacement can cause the respective outboard motor 3*a*, 3*b*, 3*c* to be steered while rotating around the swivel shaft 6.

Figure 4:
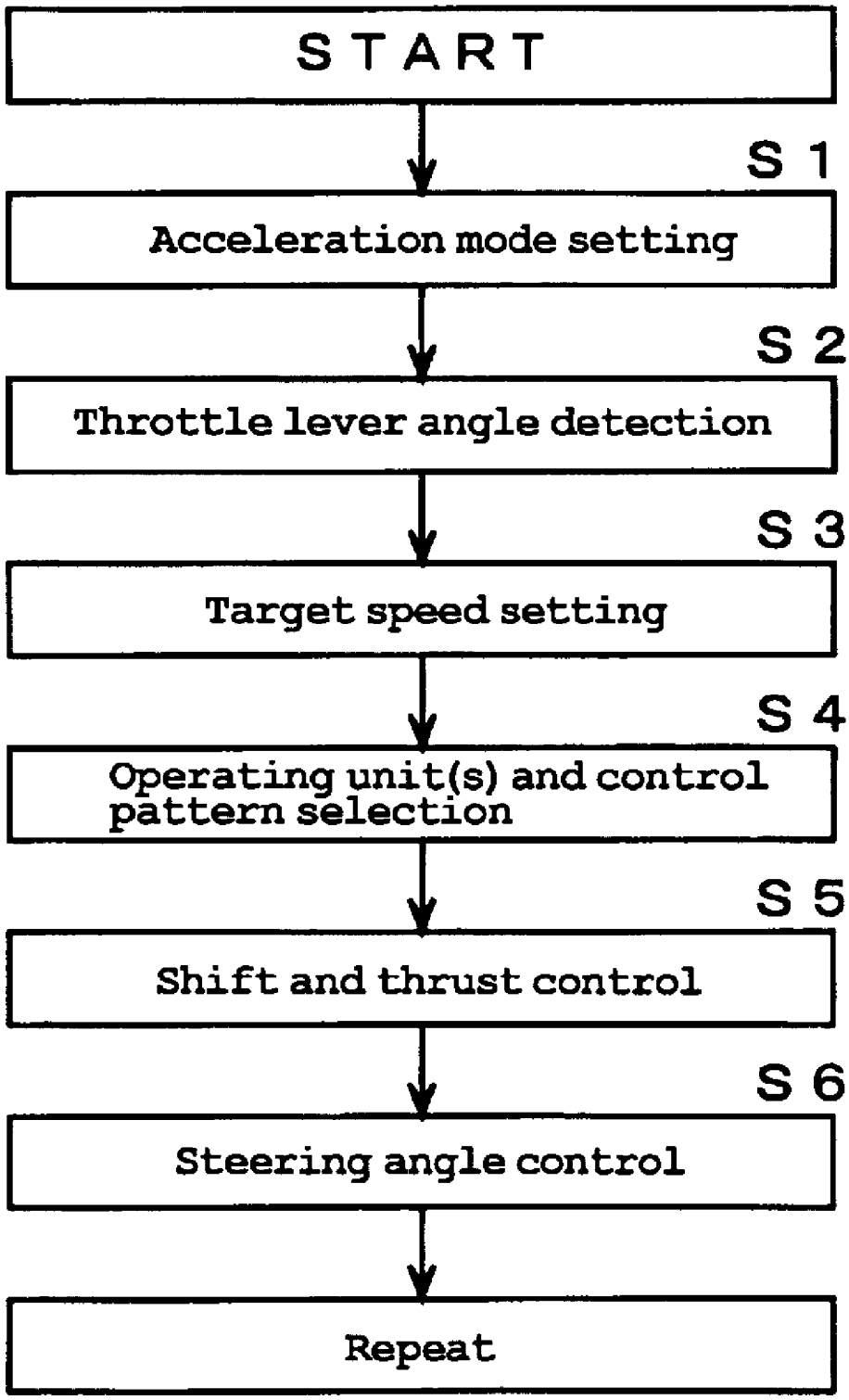
FIG. 4 is a flowchart of a low speed control procedure that can be used with the steering system of FIG. 2.

FIG. 4 is a flowchart of a low-speed control procedure that can be used with the steering system of FIG. 2. In the example illustrated in the flow chart of FIG. 4, the steering angle of three outboard motors is controlled. However, other configurations can also be used.

Figure 10:
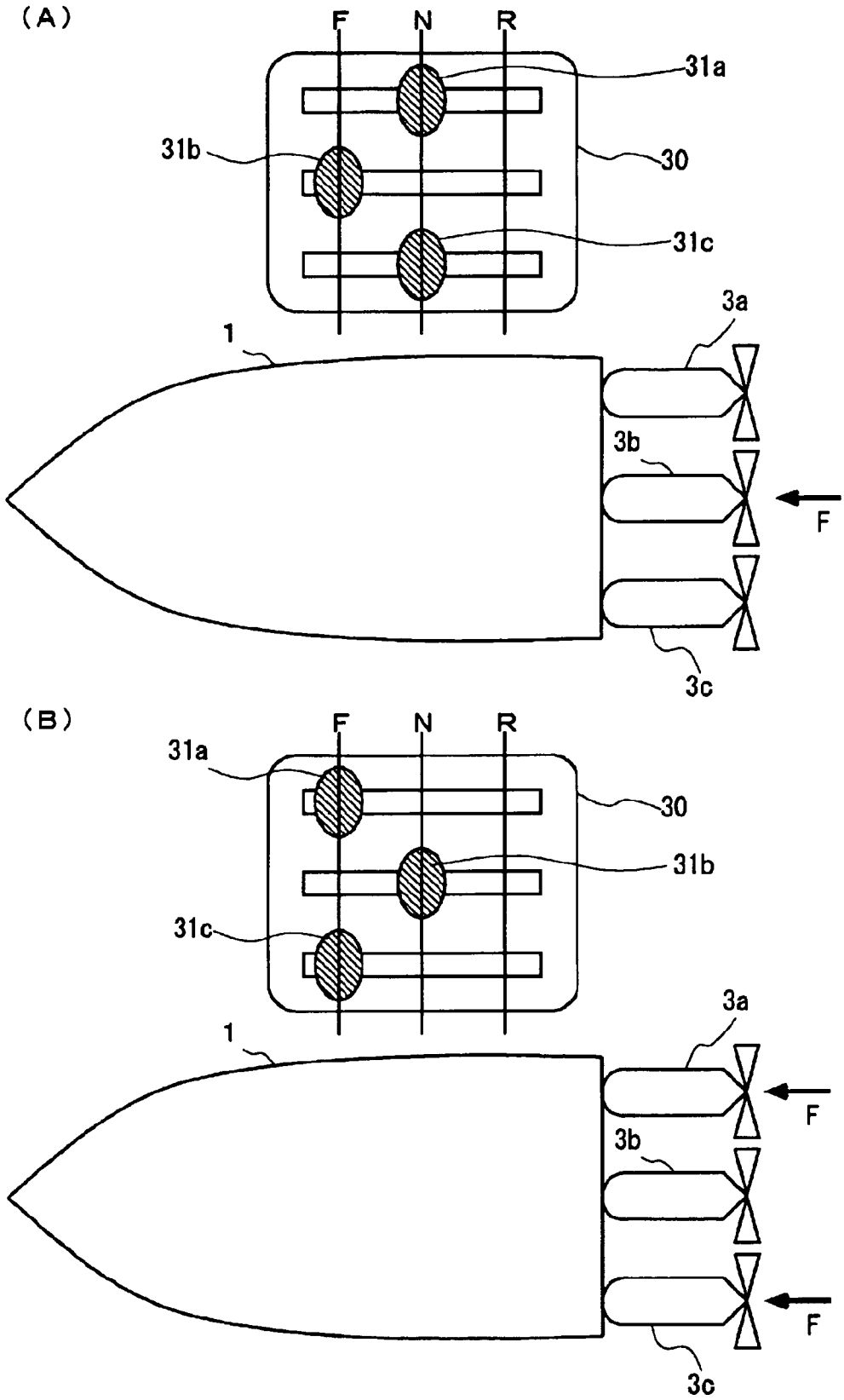
FIGS. 10A and 10B are schematic illustrations of low speed control for a boat having three outboard motors.
Figure 11:
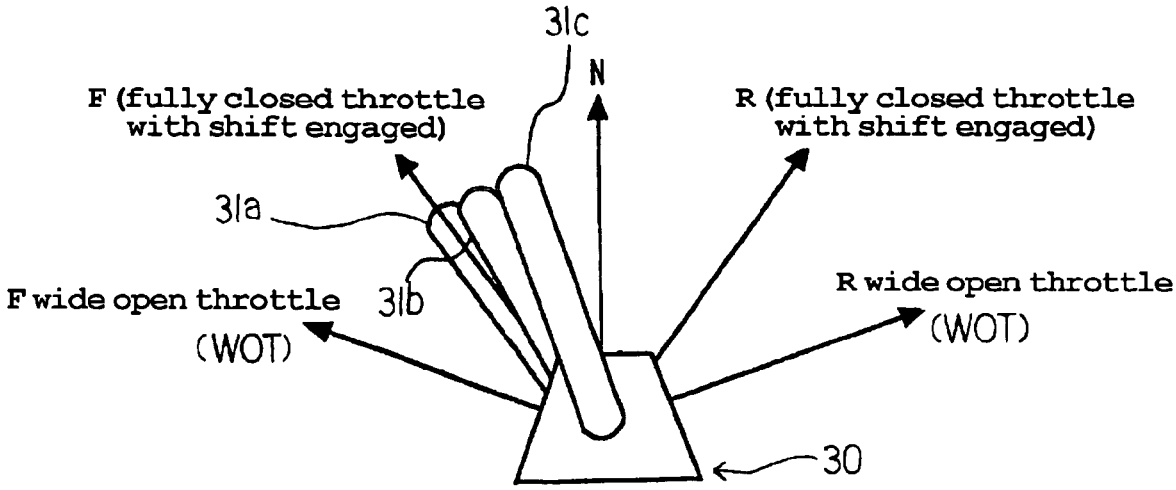
FIG. 11 is an illustration of a remote control unit that can be used to control three outboard motors mounted to a boat.

Step S1:

The acceleration mode for the throttle lever operation can be determined. for example, one remote control unit can have three throttle levers corresponding to each of the outboard motors 3*a*, 3*b*, 3*c* (see FIG. 10). To operate the boat 1 in the standard running conditions, the boat operator controls the driving of each outboard motor 3*a*, 3*b*, 3*c* by using the respective throttle lever 31*a*, 31*b*, 31*c*. Under the low speed running mode, including for example a trolling speed, one of the three throttle levers 31*a*, 31*b*, 31*c* can be used so that all three outboard motors are controlled automatically and simultaneously to run at the extremely low or minimum possible speed.

In some embodiments, two acceleration modes can be available; a standard running mode in which the driving of each outboard motor is controlled separately, and a low speed running mode in which the outboard motors are controlled to run at the extremely slow speed. The low speed running mode can be selected in Step S1 for controlling the outboard motors 3*a*, 3*b*, 3*c* to run at the extremely low speed.

The standard running mode can be set in the manner that the shifting to F with fully closed throttle can be attained as the throttle lever is inclined 20 degrees forward from the vertical position in the center, for example. Wide open throttle (WOT) can be reached at 70 degrees inclination of the throttle lever (see FIG. 8). Of course, other positions can also be used as the position at which the transmission makes the shift to the F mode and WOT is achieved. In some embodiments, the lowest running speed of the engine(s) can be obtained at the throttle lever position (F), and the maximum speed can be attained at the WOT position.

Figure 9:
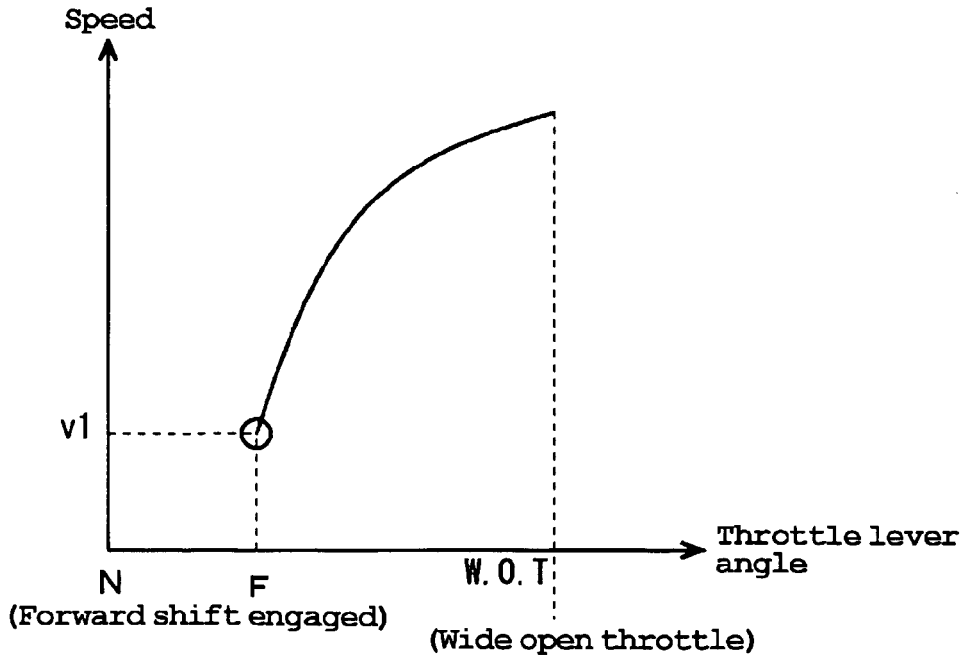
FIG. 9 is an illustration of the speed relative to the throttle lever angle with regard to a single outboard motor.

In the low speed running mode, the three outboard motors 3*a*, 3*b*, 3*c* can be controlled so that the boat speed becomes zero, that is, the target speed can be zero at the throttle lever position (F). At the wide open throttle position, on the other hand, the three outboard motors 3*a*, 3*b*, 3*c* can be controlled to set the target speed at v1 (FIG. 9) or a little higher than v1, which is equal to the lowest speed for the single outboard motor.

Optionally, two different modes can be provided in the low speed running mode. In one mode, for example, the throttle lever angular range from F to WOT (wide open throttle) can be correlated to the speed range from 0 (position (F)) to the maximum speed in the standard mode (wide open throttle position), which is indicated as low speed running mode B in FIG. 8. In the other mode, the throttle lever angular range from F to WOT can be correlated to the speed range from 0 (position (F)) to the lowest speed v1 as described above (wide open throttle position), which is indicated as low speed running mode A in FIG. 8. In this way, the speed control within the extremely slow speed range can be made easily and precisely by altering the speed range corresponding to the throttle lever angular range.

Step S2:

The throttle lever angle can also be detected with the acceleration sensor 17 (FIG. 2).

Step S3:

A target speed can be set in accordance with the detected throttle lever angle. The target speed can be a speed within the range from 0 to v1 in FIG. 9 as described above.

Step S4:

The number of operating units among the three outboard motors, and the shift control pattern can be selected to attain the target speed. The Table 1 shows an example of shift control pattern that can be used during operation while running in forward mode.

TABLE 1

| | Speed | | | | | | |
|---|---|---|---|---|---|---|---|
| | Lowest | | | | Low | | Medium~ |
| Pattern | (a) | (b) | (c) | (d) | (e) | (f) | (g) |
| Right | R | F | Turning/ Steering | R + EG Stop | — | F | F |
| Central | F | R | F | F | F | — | F |

TABLE 1-continued

| | Speed | | | | | | |
|---|---|---|---|---|---|---|---|
| | Lowest | | | | Low | | Medium~ |
| Pattern | (a) | (b) | (c) | (d) | (e) | (f) | (g) |
| Left | R | F | Turning/ Steering | R + EG Stop | — | F | F |

In Pattern (a), the left and right outboard motors are shifted into R, while the central outboard motor is shifted into F. In Pattern (b), on the contrary, the left and right outboard motors are shifted into F, while the central outboard motor is shifted into R. In pattern (c), the central outboard motor can be shifted into F, and at the same time the left and right outboard motors are turned symmetrically in the opposite directions, so that the distance between the two outboard motors is shorter at the rear part than that at the front part, or that the distance between the two outboard motors being shorter at the front part than that at the rear part. In pattern (d), the central outboard motor can be shifted into F, while the engines on the left and right outboard motors are stopped with their gears shifted in R. In Pattern (e), the central outboard motor can be shifted into F, while the engines on the left and right outboard motors are stopped, resulting in the boat running forward with only the central outboard motor. In Pattern (f), the engine on the central outboard motor can be stopped, while the left and right outboard motor are shifted into F, resulting in the boat running forward with the two outboard motors on both sides. In Pattern (g), all three outboard motors are shifted into F, resulting in the boat running forward with the three outboard motors. However, other configurations can also be used.

Step S5:

In accordance with the pattern selected in Step S4, the gear shift (forward or reverse) and the thrust for the three outboard motors 3*a*, 3*b*, 3*c* can be controlled to attain the target speed.

Step S6:

When Pattern (c) is selected in Step S4 above, the left and right outboard motors are turned symmetrically in the opposite directions, so that the distance between the two outboard motors are shorter at the rear part than that at the front part, or that the distance between the two outboard motors being shorter at the front part than that at the rear part. When the steering wheel is turned, the three outboard motors are steered simultaneously corresponding to the steering wheel turning angle.

Figure 5:
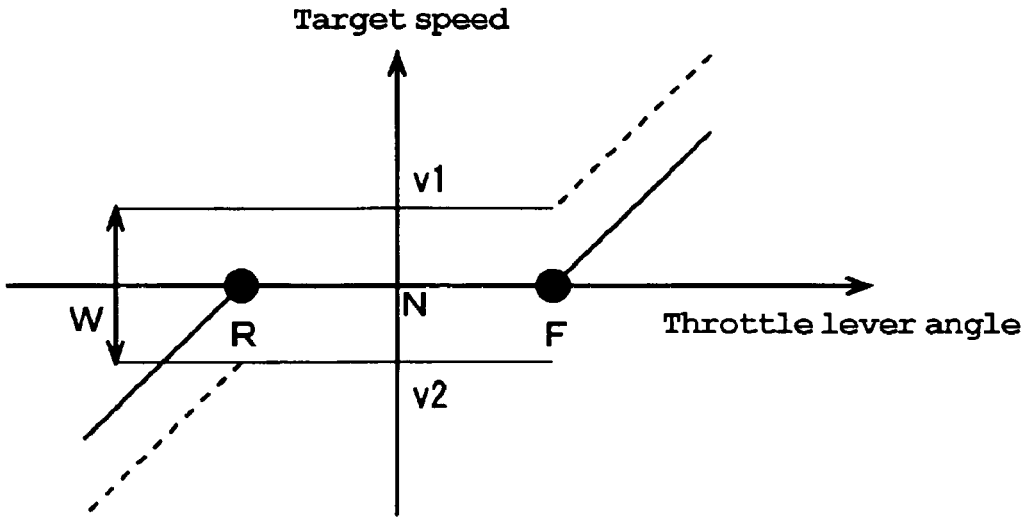
FIG. 5 is graph illustrating an exemplary relationship between target speed and throttle lever angle that can be used in conjunction with the steering system of FIG. 2.

FIG. 5 is an illustration of an exemplary relationship between target speed and throttle lever angle than can be used during operation. For example, the relationship illustrated in FIG. 5, as well as the other exemplary relationships illustrated in the form of other graphs or other relationships otherwise disclosed herein, can be incorporated into the steering system of FIG. 2 in the form of a data map or other forms.

With reference to the graph of FIG. 5, the horizontal axis denotes the throttle lever angle; an angle at which the throttle lever can be tilted. N (neutral) means that the throttle lever is vertical in the central position which can be correlated to the transmission of the respective outboard motor 3*a*, 3*b*, 3*c* being in neutral.

The forward gear of the associated transmission can be engaged to shift into F (forward) as the throttle lever is tilted frontward by 20 degrees, for instance. However, other angles also be used.

The reverse gear can be engaged to shift into R (reverse) as the throttle lever is tilted from N rearward by 20 degrees, for instance. However, other angles can also be used.

The range from R to F is the N range, in which no gear is engaged; the transmission is in neutral. When the forward gear of the transmission is engaged, and the throttle lever is at the F position, the engine can be driven at the lowest engine speed possible that would not cause engine stall, with the boat 1 running at the lowest speed v1 corresponding to the lowest engine speed. On the other hand, when the reverse gear is engaged and the throttle lever is at the R position, the engine can be driven at the lowest practicable engine speed that would not cause engine stall, as is the case with the shift into F, with the boat running at the lowest speed v2 (equals to −v1) corresponding to the lowest engine speed. Thus, with respect to an individual outboard motor, no speed can be obtained in the range W that is between the speed v2 to the speed v1. The present invention allows the speed adjustment in the range W by utilizing plural outboard motors, enabling the target speed setting at extremely slow speeds (from 0 to v1) in forward or in reverse.

Figure 6:
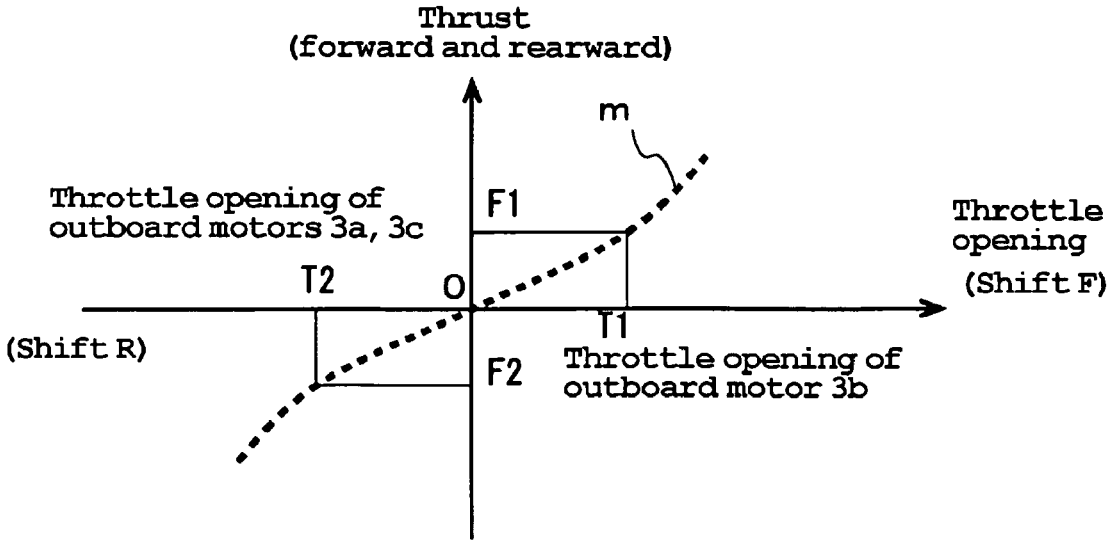
FIG. 6 is graph illustrating an exemplary relationship between thrust and throttle opening that can be used in conjunction with the steering system of FIG. 2.

FIG. 6 is an illustration of the thrust setting. More specifically, FIG. 6 shows an example of Pattern (a) described above. As shown by the graph (m) in the illustration, a map can be provided representing the relation between the outboard motor throttle opening and the thrust. Based on the map, the throttle opening can be adjusted for the central outboard motor 3*b* and for the left and right outboard motors 3*a*, 3*c* so that the thrust provided by the three outboard motors altogether can be equal to the target amount of thrust (0, for instance). As an example, the thrust F2 provided by the left and right outboard motors 3*a*, 3*c* respectively at the throttle opening T2 can be adjusted to be the half of the thrust F1 provided by the central outboard motor 3*b* at the throttle opening T1. This results in the thrust of almost 0 provided by the three outboard motors altogether (F1−2×F2).

Figure 7:
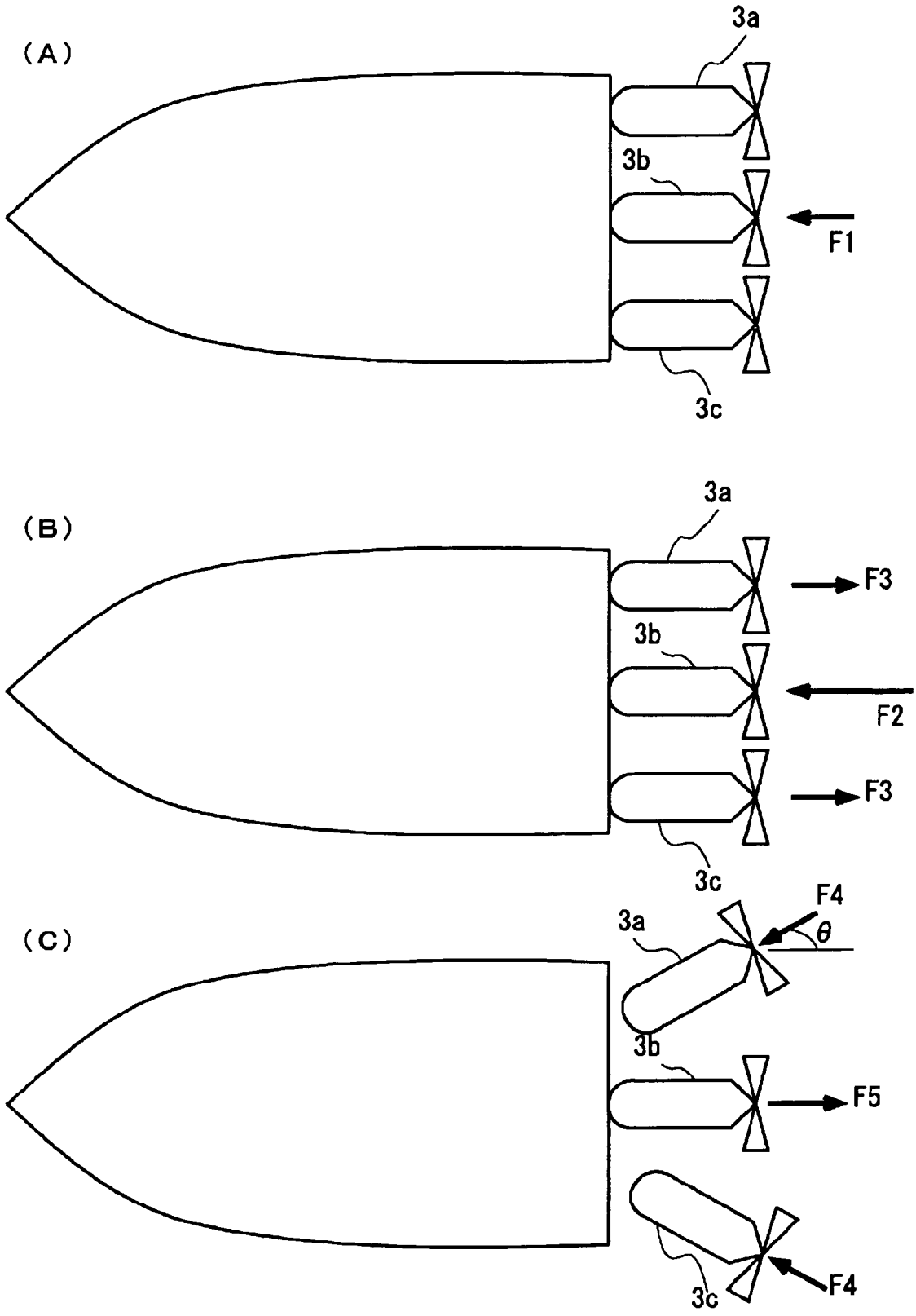
FIGS. 7A, 7B, and 7C are schematic illustrations of the thrust provided by the outboard motors during a low speed running state that can be used in conjunction with the steering system of FIG. 2.

FIGS. 7(A) and (B) illustrate the thrust provided by the three outboard motors in low speed running. FIG. 7(A) shows the driving state in the low speed running in which only the central outboard motor 3*b* can be activated, while the left and right outboard motors are stopped. The driving state of FIG. 7(A) is relevant to the Pattern (e) as defined above. The boat runs in slow speed by the thrust F1 provided solely by the single outboard motor.

FIG. 7(B) shows the extremely slow running state defined as Pattern (a) above, in which the left and right outboard motors are shifted into R, while the central outboard motor can be shifted into F. The forward thrust F2 and the reverse thrust F3 cancel with each other to generate a subtle forward thrust altogether (F2−2×F3), resulting in the extremely slow running of the boat.

FIG. 7(C) shows a pattern similar to the Pattern (c) as defined above, in which the central outboard motor 36 is shifted into R, and the left and right outboard motors 3*a*, 3*c* are turned symmetrically in the opposite directions by the turning angle θ to make the distance between the two outboard motors being shorter at the front part than that at the rear part. The forward thrust (2×F4.cos θ) and the reverse thrust (F5) cancel with each other to generate a subtle forward thrust altogether, resulting in the extremely slow running of the boat.

Figure 8:
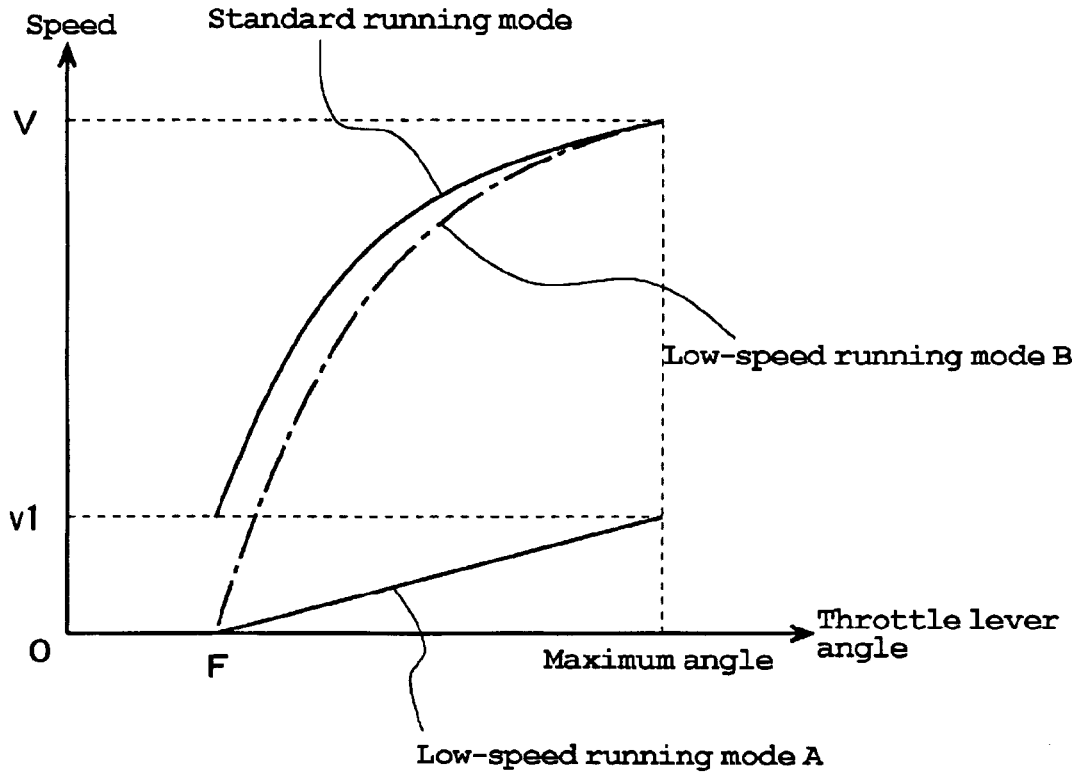
FIG. 8 is graph illustrating an exemplary relationship between throttle lever angle and engine speed that can be used in conjunction with the steering system of FIG. 2.

FIG. 8 illustrates exemplary acceleration modes. In the standard running mode, the lowest speed v1 can be attained when the throttle lever is tilted to the angle of shifting into F. As the throttle lever tilting angle is increased to the full extent, the maximum speed V is attained with wide open throttle.

In both the low speed running modes A, B, no speed (0) can be obtained when the throttle lever is tilted to the angle of shifting into F. The speed increases gradually as the throttle lever angle is increased. In the low speed running mode B, the speed V is attained when the throttle lever is tilted to the maximum angle. In the low speed running mode A, however, the speed gets to v1 when the throttle lever is tilted to the maximum angle. In the case of low speed running mode A, the entire range of the throttle lever angle corresponds to the extremely slow speed range from 0 to v1. Thus, the fine adjustment of the speed within the extremely low speed range can be made easily in mode A in comparison with mode B.

In this way, the present invention allows the speed control in the extremely low speed range down to the point of no speed (0) by selecting the low speed running mode in the step of determining the acceleration mode (step S1 in FIG. 4). Further, by altering the speed range corresponding to the throttle lever angular range, the speed adjustment in the extremely low speed range can be made more easily and precisely.

The present inventions can be applied to boats having multiple outboard motors. Further advantages can be achieved where three or more outboard motors are used, as this increases the number of different modes of operation; different combinations of some outboard motors being in forward gear with others in reverse, engines off with the propeller locked in reverse gear, etc.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A propulsion system comprising at least first, second, and third propulsion units mounted at the stem of the boat, at least the second propulsion unit being mounted between the first and third propulsion units, each of the propulsion units configured to generate thrust for propelling the boat, at least a first steering input device, a control unit configured to control the operation of each propulsion unit and a target speed setting device configured to establish a target speed of the boat, at least a first steering control device configured to steer all of the first, second, and third propulsion units based on the first steering input device, wherein the control unit is further configured to control the driving of each propulsion unit according to a preset driving pattern to attain the target speed, wherein at least one of a thrust or a direction of thrust generated the second propulsion unit is adjusted to be different from the remaining propulsion units.

2. The propulsion system according to claim 1, wherein the controller is configured to define at least one driving pattern in which at least first and third propulsion units which are disposed symmetrically relative to a longitudinal centerline of the boat are turned in opposite directions relative to the centerline by identical angles, and the second propulsion unit is activated.

3. The propulsion system according to claim 1, wherein the controller is configured to define at least one driving pattern in which at least the second propulsion unit is activated and the engines of at least the first and third propulsion units are stopped.

4. The propulsion system according to claim 1, wherein the controller is configured to define at least one driving pattern in which at least the second propulsion unit is controlled to direct thrust to oppose the thrust produced by the first and third propulsion units.

5. The propulsion system according to claim 1, wherein the target speed setting device includes a common throttle lever connected to the first, second, and third propulsion units, and the target speed setting is determined by the angle to which the throttle lever is tilted.

6. The propulsion system according to claim 5, wherein a speed range corresponding to a throttle lever angular range can be switched to have a different speed range.

7. The propulsion system according to claim 1, wherein the first, second, and third propulsion units are outboard motors.

8. A propulsion system comprising at least first, second, and third propulsion units mounted at the stem of the boat, each of the propulsion units configured to generate thrust for propelling the boat a control unit configured to control the operation of each propulsion unit and a target speed setting device configured to establish a target speed of the boat, a steering input device and a steering module configured to steer all of the first, second, and third propulsion devices based on the steering input device, wherein the control unit includes means for independently changing a thrust amount and thrust direction of each of the propulsion units to provide a plurality of different low speed forward propulsion modes each of which provide a forward boat speed that is lower than a speed resulting from one of the propulsion units being operated in a forward mode of operation at its lowest engine speed.

9. The propulsion system according to claim 8, wherein the propulsion units are outboard motors.

10. The propulsion system according to claim 1, wherein the controller is configured to define at least one driving pattern in which at least the second propulsion unit is activated and in forward gear and the engines of at least the first and third propulsion units are stopped with their gears engaged.

11. The propulsion system according to claim 1, wherein the controller is configured to define at least one driving pattern in which at least the first and third propulsion units is activated and the engine of at least the second propulsion unit is stopped.

12. The propulsion system according to claim 1, wherein the controller is configured to define at least one driving pattern in which each of at least the first and third propulsion units are controlled to produce about half of the thrust produced by the second propulsion unit.

13. The propulsion system according to claim 1, wherein the steering input device is a steering wheel.

14. The propulsion system according to claim 8, wherein the steering input device is a steering wheel.

* * * * *

UNITED STATES PATENT AND TRADEMARK OFFICE

CERTIFICATE OF CORRECTION

PATENT NO. : 7,455,557 B2
APPLICATION NO. : 11/588060
DATED : November 25, 2008
INVENTOR(S) : Makoto Mizutani It is certified that error appears in the above-identified patent and that said Letters Patent is hereby corrected as shown below:

In column 1, line 22, change "and" to --an--.

In column 1, line 38, change "rearward." to --rearwardly.--.

In column 2, line 54, after "difficult" insert --for the--.

In column 5, line 25, change "igniting" to --ignition--.

In column 5, line 60, change "for" to --For--.

In column 7, line 16, change "pattern" to --Pattern--.

In column 7, line 22, change "pattern" to --Pattern--.

In column 7, line 66, after "angles" insert --can--.

In column 9, line 50, in Claim 1, change "stem" to --stern--.

In column 10, line 27, in Claim 8, change "stem" to --stern--.

Signed and Sealed this

Twenty-seventh Day of April, 2010

David J. Kappos

David J. Kappos
*Director of the United States Patent and Trademark Office*